United States Patent [19]

Stahlecker

[11] Patent Number: 4,570,434

[45] Date of Patent: Feb. 18, 1986

[54] FIBER FEED ARRANGEMENT FOR OPEN-END FRICTION SPINNING

[75] Inventor: Fritz Stahlecker, Bad Überkingen, Fed. Rep. of Germany

[73] Assignees: Hans Stahlecker; Fritz Stahlecker, both of Fed. Rep. of Germany

[21] Appl. No.: 619,136

[22] Filed: Jun. 11, 1984

[30] Foreign Application Priority Data

Jun. 9, 1983 [DE] Fed. Rep. of Germany ..... 3320768

[51] Int. Cl.[4] ..... D01H 7/882; D01H 7/892

[52] U.S. Cl. ..... 57/401; 57/408; 57/409; 57/411

[58] Field of Search ..... 57/327, 401, 408, 409, 57/411

[56] References Cited

U.S. PATENT DOCUMENTS 4,165,600 8/1979 Schippers et al. ..... 57/401
4,202,163 5/1980 Turk et al. ..... 57/401
4,241,574 12/1980 Turk et al. ..... 57/401 X

FOREIGN PATENT DOCUMENTS 2810184 9/1979 Fed. Rep. of Germany .

*Primary Examiner*—John Petrakes
*Attorney, Agent, or Firm*—Barnes & Thornburg

[57] ABSTRACT

A method and apparatus for open-end friction spinning is disclosed having two adjacently arranged friction rollers, driven in the same rotational direction and forming a wedge-shaped gap therebetween. A suction device effective in the area of the gap as well as a fiber feed channel leading to the gap and a yarn withdrawal device for drawing off the produced yarn in the direction of the gap are also provided. It is further provided that the mouth of the fiber channel extending at a tangential angle to the gap is widened in the area of the gap in that the channel wall facing the same is formed with a rounded curve. By these measures the fiber deposition in the gap is improved by modifying the fiber transport air stream path to deposit the fibers in a straightened and parallel manner in the gap.

17 Claims, 4 Drawing Figures

A
B
C
D
E
F
G
H
I
J
II
III
V
T

FIBER FEED ARRANGEMENT FOR OPEN-END FRICTION SPINNING

BACKGROUND AND SUMMARY OF THE INVENTION

The invention relates to a method and apparatus for open-end friction spinning with two friction rollers, driven in the same rotational direction and adjacently arranged to form a yarn forming wedge-shaped gap therebetween with a suction device effective in the area of the wedge-shaped gap. A fiber feed channel leads from an opening and feeding device to the wedge-shaped gap, which channel extends at a sharp angle to the gap. A yarn withdrawal device is provided for drawing off the produced yarn in the direction of the extension of the wedge slot.

An important problem with open-end friction spinning machines of the above-mentioned kind is that the fibers should be deposited within the wedge-shaped gap in a straight and parallel manner because the quality of yarn produced is highly dependent on such deposition of the fibers.

A known device of the above-mentioned type disclosed in German Published Unexamined Application (DE-OS) No. 28 10 184 has a fiber feed channel which is steadily widened up to the feeding mouth or opening opposite the wedge-shaped gap. It is thereby attained that the fibers leaving the opening roller in an extended or straightened manner make a pivotal motion and arrange themselves parallel to the wedge shaped gap. However, this method does not consider that along with the steadily widening of the fiber feed channel, also the speed of airstream necessary for transportation of the fibers decreases so that the trailing ends of the fibers accelerate faster than the leading ends. This leads directly after a very short transportation distance to a tangled position of the fibers within the fiber feed channel making it impossible to have a controlled and orderly fiber deposition in the yarn forming gap.

A principal problem involved in a straightened and orderly deposition of fibers within the wedge-shaped gap results from the fact that under normal conditions the transportation speed with which the fibers are fed in is substantially faster than the drawings off or withdrawal speed of the produced yarn. Under these conditions, the incoming fibers reaching the yarn forming gap are slowed down so that they are shoved or buckled resulting in a hairpin-like distortion of the fibers.

It is an object of this invention to provide a device of the above-mentioned type with optimum straightened parallel fiber deposition within the yarn forming gap.

This object is achieved by the invention providing that the mouth of the fiber feed channel is widened in the area of the yarn forming gap and providing that the fiber feed channel wall facing away from the yarn forming gap is configured with a convex curve shape.

Through this one-sided widening of the fiber feed channel in the area of the feeding mouth by means of slightly sloped curve, the air stream necessary for fiber transportation is changed whereby the fibers somewhat follow the change in slope directed over and above from the yarn forming gap so that the same reach this gap subsequently with both of their ends almost at the same time. A shoving/buckling of the fibers is thereby no longer to be expected despite the lower draw off speed of the yarn to be produced.

In advantageous preferred embodiments of the invention, the channel wall opposite the wedge-shaped yarn forming gap forms a convex curvature towards this gap with a constant turning radius. It is thereby advantageous if the end of the channel wall facing the gap is formed parallel to the longitudinal direction of the gap. Thereby, the entire length of the mouth area is utilized for straightening out of the fibers.

In an advantageous arrangement of the invention it is provided that the fiber feed channel is arranged essentially to extend in the withdrawal direction of the yarn to be produced. Thereby, the fibers are withdrawn in the same direction as they are fed in so that fiber buckling due to a turn around of the fibers is avoided. Due to the curved channel wall and the turning of the fibers due to the turning of the airstream, buckling of the fibers is avoided in spite of the slowdown of the incoming ends of the fibers.

The fiber channel up to the area of the feeding mouth preferably consists of an almost constant, advantageously groove-like cross section. It is thereby assured that the fibers that leave the feeding and opening device in a straightened position will also remain in said position up to the area of the mouth and then first obtain the desired curvature or bending. It is advantageous according to especially preferred embodiments to configure the length of the fiber feed channel to be larger than the average fiber length of the staple fiber material that is being processed and preferably is about twice the length of the average staple length. The fiber feed channel thereby performs an additional straightening effect.

It is also advantageous according to a further development of preferred embodiments of the invention to configure the total length of the mouth of the fiber feed channel in the direction to the gap corresponds to at least the average length of the staple of the fiber material to be processed. It is thereby attained that almost all fibers are turned within the area of the mouth corresponding to the widening of the channel and are evenly deposited in the yarn forming gap.

In yet a further development of the invention, it is provided that the suction device is adaptable to different suction effects at various locations in longitudinal direction of the yarn forming gap, whereby a higher suction effect is obtained in the area of the rounded channel wall. It is thereby further possible to support the turning of the airstream along the curved channel wall and as a result the turning of the fibers. In a further development of the invention it is provided that the area of the mouth of the fiber feed channel includes a device for producing an additional air stream which is essentially directed in the longitudinal direction of the yarn forming gap toward the rounded or curved channel wall. This additional air stream strengthens the turning of the transportion air stream and thereby the adjustment of the fibers to be fed along the wedge gap and the curved channel wall so that the straightened deposit of fibers is further improved.

Further objects, features, and advantages of the present invention will become more apparent from the following description when taken with the accompanying drawings which show, for purposes of illustration only, embodiments in accordance with the present invention.

DETAILED DESCRIPTION OF THE DRAWINGS

Figures 1, 2, 3:
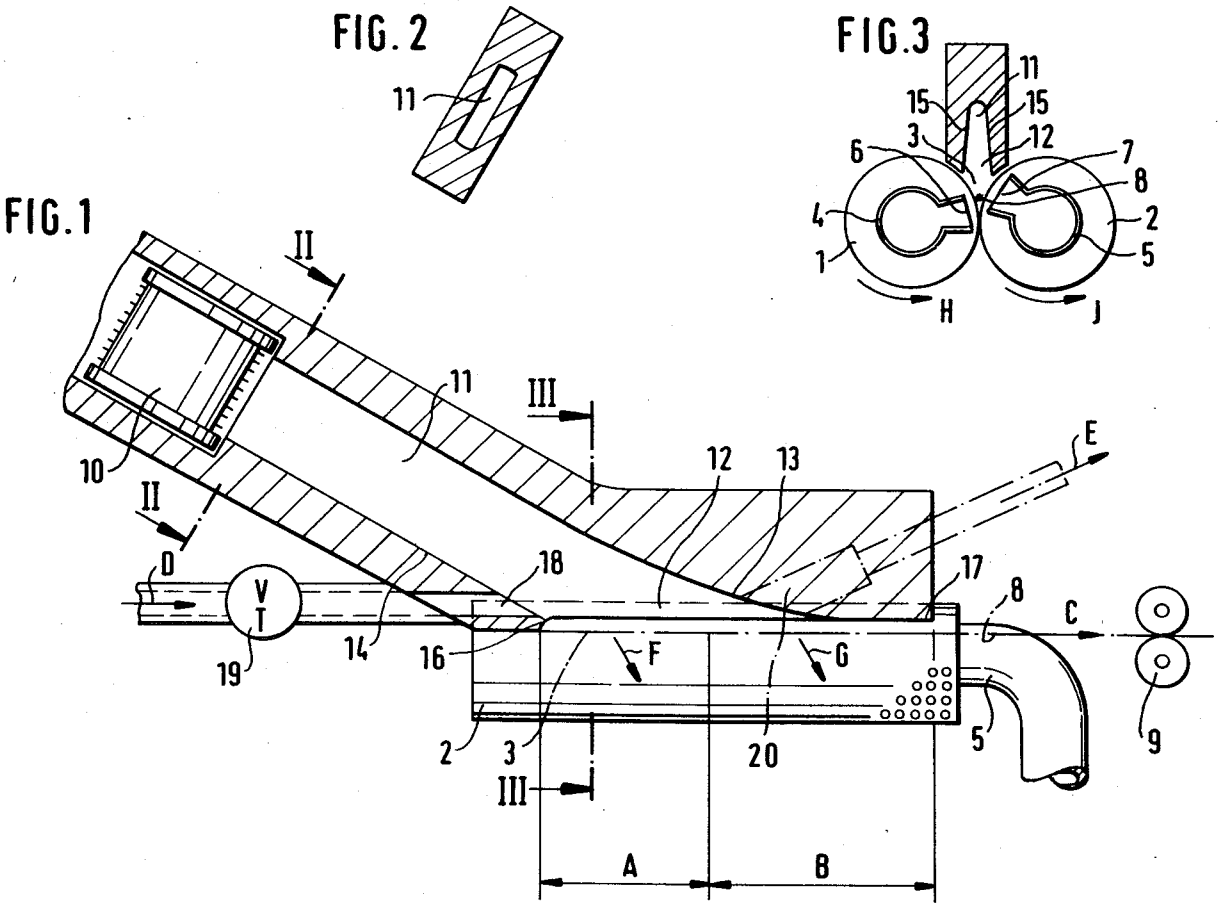
FIG. 1 is a side schematic part-sectional view showing a device for open-end friction spinning with a fiber feed channel designed in accordance with a preferred embodiment of the present invention.
FIG. 2 is a cross sectional view taken along line II—II through the fiber feed channel of FIG. 1.
FIG. 3 is a cross sectional view taken along line III—III through the area of the mouth of the fiber feed channel of FIG. 1.

The arrangement shown in FIG. 1 includes two adjacently arranged rollers 1 and 2 which are parallel to each other and are driven by means of a drive means not further described, in the direction of arrows H and J. The two rollers 1 and 2 form a wedge-shaped gap 3 therebetween in which the yarn formation takes place.

With this embodiment, the two rollers 1 and 2 are formed as so-called suction rollers. They include cover surfaces with perforations, suction inserts 4 and 5 being both connected to a sub-atmospheric pressure source arranged inside the cover surfaces. The suction inserts 4 and 5 (FIG. 3) include longitudinal slots 6 and 7 opening towards the area of the wedge shaped gap 3 so that in this area both rollers 1 and 2 benefit from a suction air stream.

A fiber feed channel 11 leads to the gap 3 from an inlet and opening device of which only opening roller 10 mounted at its circumference is shown. The fiber feed channel 11 is guided closely to the wedge gap 3 and the cover surfaces of rollers 1 and 2 so that a transportation air stream is developed through suction air streams in the area of the gap 3 within the fiber feed channel 11. The fiber feed channel 11 extends in the plane of gap 3, i.e., in a plane extending perpendicular to the plane connecting the two axes of rollers 1 and 2 and extend through the gap 3. The fiber feed channel 11, extending tangentially to the circumference of the opening roller 10, runs in a straight line and includes a constant and groove-like cross section up to the area of its mouth 12. The feed channel 11 has a greater dimension in the plane through wedge slot 3 mentioned above as shown in FIG. 2.

The inlet and opening device has a construction known from open end rotor spinning systems. This device unravels or opens up a supplied fiber band sliver into single fibers which are subsequently delivered through the fiber feed channel 11 into the area of the gap 3. The supplied fibers are spun to a yarn 8 within the gap 3 and said yarn is drawn off in the longitudinal direction of the gap 3 (arrow C of FIG. 1) by means of a withdrawal device, for example a draw off roller pair 9. The fiber feed channel 11 is tangentially inclined toward the gap 3 and the draw off direction C of the produced yarn 8 in such a manner that the yarn withdrawal essentially occurs in the direction of feed in of the fiber feed-in channel 11.

Despite the fact that the speed of feed in of the fibers is higher than the withdrawal speed of the produced yarn 8, and in order to obtain a proper fiber deposit, a special construction of the fiber feed in channel 11 in the area of its mouth 12 is provided. This construction consists therein that the fiber feed in channel 11 is widened in the area of the mouth 12 and in the direction of the yarn withdrawal C in such a manner that the channel wall 13 opposite to the gap 3 curves away from the gap with a slight bending or curving. The channel wall 13 which exhibits an essentially uniform curving radius in the area of the gap 3 starts tangentially to the corresponding wall in the area before the mouth 12 and extends such, that its end 17 is arranged parallel to the longitudinal direction of gap 3. It is thereby provided that the entire length of the fiber feed channel 11 is about double the average staple length of the fiber material to be processed, and the length of the mouth 12 in the direction toward the gap 3 is about the average staple length (compare dimensions of FIG. 1 illustration).

By widening the mouth 12 in the longitudinal direction of the gap 3, a curving of the transportation air stream and thereby of the fibers is obtained, the fibers being curved approximately corresponding to the curve of the wall 13. When these downstream ends of the fibers then reach the gap 3 and are slowed down, the fiber ends are then moved further in the direction of the existing air transportation, that is into wedge slot 3 without shoving or pushing the fibers to any great extent.

In order to support the excursion of the air stream in the area of the mouth 12 and thereby essentially influence the downstream fiber ends, an air flow opening 18 is provided in the wall 14 opposite the rounded channel wall 13 and in close proximity of gap 3 over which air is either sucked in from the atmosphere or, if need be, pressurized air is supplied via a pressure air source. The air flow opening 18 is advantageously provided with throttling device 19 in order to control the amount of supplied air. The air stream is thereby essentially directed in the longitudinal direction of gap 3 so that the air stream necessary for transportation and correspondingly the fibers that are supplied, are being turned.

In addition to the supplied air stream D obtained by means of the air flow opening 18 or as an alternative hereto, it is suggested to produce an air stream E with which a turning of the air stream necessary for transportation and the fibers that reach the same is obtained. A suction opening 20 is for this purpose provided in the curved channel wall 13 which is connected to a sub pressure source not further described here. A control device between the suction air source and the suction opening 20 is advantageously provided, for example a throttle valve, since the effect of suction opening 20 has to be controlled in such a manner that it does not suck in any fibers.

In addition or as a substitute to the above-mentioned measures, the turning of the air stream necessary for transportation and the fibers supplied by the same can also occur namely in different longitudinal positions along gap 3 whereby an improved suction effect is obtained in the area of the rounded channel wall 13. This may occur, for example, in that the suction inserts 4 and 5 are provided with widened slot openings 6 and 7 in the transportation direction of the fibers so that differently strong suction air streams F and G occur in the areas A and B.

Figure 4:
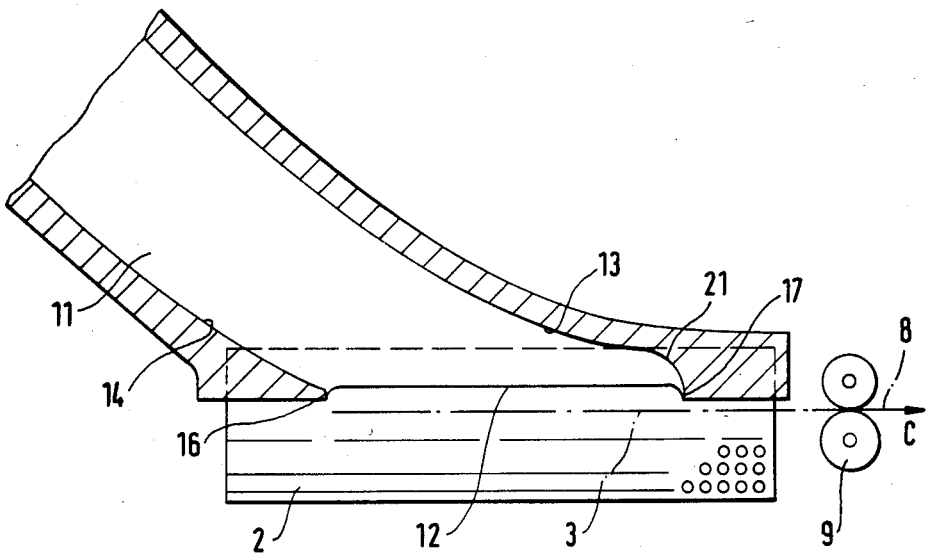
FIG. 4 is a view similar to FIG. 1, showing another preferred embodiment of the invention.

The embodiment of FIG. 4 corresponds in its principle construction to the embodiment according to FIGS. 1 through 3. In order to cover the gap 3 at the side facing the withdrawal device 9 and thereby to seal the suction devices 4, 6; 5, 7 to the outside as much as possible, the end of the component part housing the channel 11, especially the mouth 12 thereof, is inserted into the gap 3 as deeply as possible and extended to about the end of rollers 1 and 2. This component part then connects at the convex channel wall 13 with a curve 21 directed towards the gap 3. Channel wall 14 as well extends with an approximately parallel curvature to the channel wall 13 in order to cover and seal the gap 3 in its area.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Open end friction spinning apparatus comprising:

drivable friction surface means defining a yarn formation zone, fiber supplying means for supplying individual fibers to the yarn formation zone, suction device means for applying suction forces to the area of the yarn formation zone to assist in feeding the fibers thereto and to hold the same during yarn formation thereat, and yarn withdrawal means for withdrawing yarn from the yarn formation zone, wherein said fiber supplying means includes a fiber feed channel extending at an angle to the longitudinal extension of the yarn formation zone wherein the mouth of the fiber feed channel is widened in the area of the yarn formation zone and the fiber feed channel wall facing the yarn formation zone is curved convexly to facilitate control of the fiber transport air stream and fibers to optimize alignment of the fibers in the yarn formation zone.

2. Apparatus according to claim 1, wherein the channel wall opposite the zone forms a convex curve towards the zone with a constant radius of curvature.

3. Apparatus according to claim 1, wherein the end of the channel wall opposite the zone extends parallel to the longitudinal direction of the zone.

4. Apparatus according to claim 1, wherein the fiber feed channel extends essentially in the withdrawal direction of the yarn being produced.

5. Apparatus according to claim 1, wherein the fiber feed channel exhibits an at least approximately constant, preferably groove-like cross section up to the area of the mouth.

6. Apparatus according to claim 1, wherein the fiber feed channel extends linearly up to the area of the mouth.

7. Apparatus according to claim 1, wherein the fiber feed channel is laterally widened transversely to the transportation direction of the fibers in the area of the mouth, with the channel side walls extending in a V-shaped manner.

8. Apparatus according to claim 1, wherein the length of the fiber feed channel is greater than the average staple length of the fiber material to be processed, preferably about twice the length of the average staple length.

9. Apparatus according to claim 1, wherein the entire length of the mouth of the fiber feed channel in the direction of the zone corresponds at least to the average staple length of the fiber material to be processed.

10. Apparatus according to claim 1, wherein said suction device means includes means for applying different suction effect to different sections of the length of the zone, whereby a greater suction effect is effected in the area of the curved channel wall.

11. Apparatus according to claim 1, wherein an air flow inducing device is directed essentially in the longitudinal direction of the zone towards the curved channel wall.

12. Apparatus according to claim 11, wherein the air flow inducing device includes an air flow opening connected to a pressure air source provided at the wall opposite the curved wall of the fiber feed channel.

13. Apparatus according to claim 12, wherein the air flow inducing device includes a control device for controlling the magnitude of the air streams.

14. Apparatus according to claim 12, wherein the air flow inducing device includes a suction opening connected to a subpressure source provided in the curved wall of the fiber feed channel.

15. Apparatus according to claim 14, wherein the air flow inducing device includes a control device for controlling the magnitude of the air streams.

16. Apparatus according to claim 11, wherein the air flow inducing device includes a suction opening connected to a subpressure source provided in the curved wall of the fiber feed channel.

17. Apparatus according to claim 1, wherein the drivable friction surface means comprises a pair of adjacently arranged friction rollers rotatably drivable in the same direction and the yarn formation zone comprises a wedge-shaped gap formed between the pair of friction rollers.

* * * * *